US007131776B2

(12) United States Patent
Aoshima et al.

(10) Patent No.: US 7,131,776 B2
(45) Date of Patent: Nov. 7, 2006

(54) PRINTED MATTER RELIABILITY DECISION METHOD

(75) Inventors: Hirokazu Aoshima, Cannes (FR); Yoshiyasu Takahashi, Yokohama (JP); Yasuhiro Fujii, Fujisawa (JP); Hideo Noyama, Yokohama (JP); Takeshi Matsuki, Musashino (JP)

(73) Assignee: Hitachi, Ltd., Tokyo (JP)

( * ) Notice: Subject to any disclaimer, the term of this patent is extended or adjusted under 35 U.S.C. 154(b) by 219 days.

(21) Appl. No.: 10/947,214

(22) Filed: Sep. 23, 2004

(65) Prior Publication Data

US 2005/0226666 A1 Oct. 13, 2005

(30) Foreign Application Priority Data

Apr. 13, 2004 (JP) ..... 2004-117431

(51) Int. Cl.
*B41J 11/44* (2006.01)

(52) U.S. Cl. ..... 400/76; 400/61; 382/100

(58) Field of Classification Search ..... 400/60, 400/61, 70, 76; 358/1.9, 1, 18; 340/5.86; 283/902; 382/100, 135
See application file for complete search history.

(56) References Cited

U.S. PATENT DOCUMENTS

| | | | | |
|---|---|---|---|---|
| 4,218,674 | A | 8/1980 | Brosow et al. | |
| 5,647,010 | A * | 7/1997 | Okubo et al. | 382/100 |
| 5,781,653 | A * | 7/1998 | Okubo | 382/135 |
| 6,427,020 | B1 * | 7/2002 | Rhoads | 382/100 |

FOREIGN PATENT DOCUMENTS

| | | |
|---|---|---|
| JP | A-52-33444 | 9/1976 |
| JP | 57-500851 | 5/1982 |
| JP | 57-161993 | 10/1982 |
| WO | WO 82/00062 | 1/1982 |

* cited by examiner

*Primary Examiner*—Minh Chau
(74) *Attorney, Agent, or Firm*—Antonelli, Terry, Stout and Kraus, LLP.

(57) ABSTRACT

The problem is to make a reliability decision on printed matter without using special ink or a dedicated blank. At least a part of a feature of a state included in printed matter is recorded by using a predetermined method at the time of printing. At the time of verification, the feature of the state acquired from the printed matter is compared with the feature recorded at the time of printing to conduct verification. As this feature, a feature value determined on the basis of a feature of the state of the printed matter, in the state of the printed matter determined in association with spatial distribution of a coloring portion on the printing surface, at the time when printing first information to be recorded is used.

12 Claims, 6 Drawing Sheets

PRINTED MATTER RELIABILITY DECISION METHOD

INCORPORATION BY REFERENCE

This application claims priority based on a Japanese patent application, No. 2004-117431 filed on Apr. 13, 2004, the entire contents of which are incorporated herein by reference.

BACKGROUND OF THE INVENTION

The present invention relates to a printed matter reliability decision method for verifying falsification and duplication conducted on printed matter.

In some conventional paper documents, contents described in the documents or their values are trusted by conducting processing using an advanced printing method on the documents so as to prevent them from being easily duplicated or counterfeited. For example, those documents are securities represented by bills, and certificates such as licenses or certificates of qualification. In these documents, countermeasures such as use of a blank having a watermark formed by adding subtle unevenness to paper, use of high definition relief printing, and use of special ink that reacts to ultraviolet rays or the like are taken sometimes. These countermeasures rely on use of a special material that is not easily available for the blank or ink or use of a high definition printing technique that cannot be implemented easily or cheaply, as foundation for obtaining reliability.

Furthermore, as described in Japanese Laid Open Patent Publication No. 57-500851, there is a technique of attempting to prevent a document from being counterfeited by "inspecting an authenticator having a pattern of a measurable and unduplicable characteristic" of printed matter.

Furthermore, as described in Japanese Laid Open Patent Publication No. 52-33444, there is a technique of conducting collation against counterfeiting by observing a feature quantity included in a part of an object.

Furthermore, as described in Japanese Laid Open Patent Publication No. 57-161993, there is a technique of detecting counterfeiting or alteration by "recording issue data on an issued note having a pattern previously printed thereon" and using "inspection data including a recording position relation between the pattern and the issue data."

SUMMARY OF THE INVENTION

When using a special material for a blank or ink in order to prevent printed matter from being duplicated or counterfeited, the environment capable of creating the printed matter is subject to strict restriction according to circumstances of the management and supply of the material. Furthermore, since in recent years high definition image pickup devices and printing devices have become available at low prices, high definition printing that was difficult in the past is facilitated, resulting in a fear of paper documents being duplicated or counterfeited. Therefore, countermeasures relying upon the precision of printing are not bringing about effects.

When detecting falsification conducted on a paper document, blurring at the time of printing, an error at the time of reading, recording stably the state of paper surface represented by analog quantities as verifiable information, and reading the information at the time of verification become problems. Furthermore, in prevention of duplication, it becomes a problem to have a sufficient duplication preventing capability even in situations where high definition image pickup and printing can be conducted easily.

Furthermore, it is desired that those methods do not use special blank. If special blank is presupposed, then the restrictions occur in the supply and management of blanks and there is a possibility that aspects in which the blanks can be used will be restricted.

The present invention provides a technique for judging the reliability of printed matter and judging counterfeiting or duplication, by recording the state of printed matter at the time of printing, and comparing the state of the printed matter read from the printed matter with the state of the printed matter recorded at the time of printing, at the time of verification.

In an aspect of the present invention, at least a part of a feature of a state included in printed matter is recorded by using a predetermined method, and it is verified that the printed matter has the feature by comparison with the recorded feature.

An aspect of the present invention is a recording method of reliability decision information on printed matter using a printing system, which includes a printing apparatus and a control apparatus for the printing apparatus. The printing apparatus provides a printing surface partially with a color and thereby records first information on the printing surface under control of the control apparatus; the control apparatus determines a feature value of the printed matter on the basis of spatial distribution of the coloring portions on the printing surface at time when the first information is printed on the printing surface; and the printing apparatus records the feature value on the printing surface together with the first information.

An aspect of the present invention is a reliability decision method of printed matter using the recording method of reliability decision information on printed matter, which is used by a verification apparatus including an image reading apparatus and a control apparatus for the image reading apparatus. The image reading apparatus reads the feature value and the first information printed on the printing surface, under control of the control apparatus for the image reading apparatus; and the control apparatus for the image reading apparatus conducts comparison on the feature value and the first information printed on the printed matter, and makes a decision on reliability of the printed matter.

In the recording method of reliability decision information on printed matter, the control apparatus may determine spatial distribution of the coloring portions on the printing surface, at time when the printing apparatus prints the first information by taking a printing constituent pixel as unit, the printing constituent pixel being constituted by a predetermined number of minute pixels each taken as unit when conducting coloring on the printing surface, take a value prescribing disposition of the printing constituent pixel concerning the first information as the feature value included on the printed matter, take a plurality of index points constituted by using a smaller number of minute pixels than the predetermined number constituting the printing constituent pixel, as a background pattern having a predetermined relative arrangement relative to the printing constituent pixel, and conduct printing.

In the recording method of reliability decision information on printed matter, the control apparatus may constitute the background pattern by arranging a plurality of the index points, provide each of the index points with a shape formed by a predetermined arrangement of the minute pixels, determine disposition of the index points according to a predetermined rule, and dispose the printing constituent pixels concerning the first information in a region including an occupying region on the printing surface.

In the reliability decision method of printed matter, the control apparatus for the image reading apparatus may make a decision on at least one of boundaries and a position of the printing constituent pixel included in the first information by using the background pattern as reference, as regards the first information read from the printing surface by the image reading apparatus.

In the recording method of reliability decision information on printed matter, the feature value may be recorded by changing any of disposition, number, shape, color and density of minute pixels arranged on the printing surface.

In the recording method of reliability decision information on printed matter, the control apparatus may determine at least one sampling region taking a predetermined shape on the printing surface, and take information representing presence or absence of the coloring portion concerning the first information in the sampling region as the feature value.

In the recording method of reliability decision information on printed matter, the control apparatus may dispose the sampling region in a specific region on the printing surface.

In the recording method of reliability decision information on printed matter, the control apparatus may record at least one of: information for prescribing a region on the printing surface in which the sampling region is disposed; a parameter for determining disposition of the sampling region in the region on the printing surface; and a feature value acquired as presence or absence of coloring for the sampling region, on the paper surface.

In the recording method of reliability decision information on printed matter, the control apparatus may determine a position of the sampling region on the basis of a relative position with respect to the minute pixels constituting the background pattern.

In the recording method of reliability decision information on printed matter, the printing apparatus may include an observation unit which observes fluctuation in coloring shape or coloring position of a minute pixel taken as unit when conducting coloring on the printing surface, and the control apparatus may determine the feature value on the basis of the fluctuation.

In the recording method of reliability decision information on printed matter, the control apparatus may encrypt information of position on the printing surface in which the fluctuation is to be observed to determine the feature value of the printed matter, or the position information and the feature value of the printed matter, and cause the position information, or the position information and the feature value of the printed matter thus encrypted, to be recorded on the printing surface.

Owing to the features heretofore described, the reliability decision of printed matter becomes possible by recording the feature of the state of the printed matter and conducting comparison at the time of verification.

Furthermore, by using a feature value determined on the basis of a feature of the state of the printed matter which is determined in association with spatial distribution of a coloring portion on the printing surface, it becomes possible to verify the state change of the printed matter.

Furthermore, by determining the spatial distribution of the coloring portion on the printing surface while taking a printing constituent pixel as the unit and providing the background pattern with a predetermined relative arrangement, it becomes possible to stably acquire the feature value of the state of the printed matter.

Furthermore, by using the background pattern, it becomes possible to record information required for verification.

Furthermore, by acquiring the feature value of the state of printed matter by using sampling regions, it becomes possible to reduce the information content required to store the feature values.

Furthermore, it becomes possible to make a decision on reliability with restriction to a specific region on the paper surface.

Furthermore, it becomes possible to restrict information required to record to values of three kinds, i.e., parameters that determine the sampling regions, information that prescribe a region on the paper surface in which feature values are acquired by using the sampling regions, and feature values acquired as presence or absence of coloring for the sampling regions.

Furthermore, it becomes possible to determine the positions of the sampling regions with high precision.

Furthermore, it becomes possible to create printed matter that is difficult to duplicate.

Furthermore, it becomes possible to keep places for duplicate decision secret and improve the difficulty of duplication.

Furthermore, it becomes possible to automatically take countermeasures against duplication in the printing process of printed matter.

According to the present invention, it becomes possible to prevent duplication and counterfeiting of printed matter without using special paper.

These and other benefits are described throughout the present specification. A further understanding of the nature and advantages of the invention may be realized by reference to the remaining portions of the specification and the attached drawings.

DETAILED DESCRIPTION OF THE EMBODIMENTS

Figure 1:
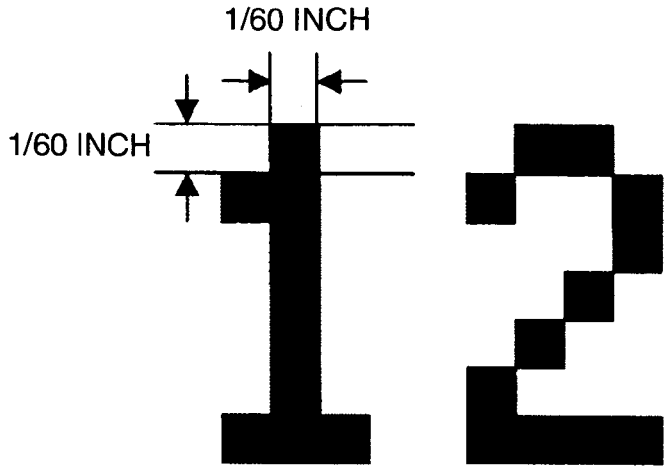
FIG. 1 is a diagram showing printing using printing constituent pixels in an embodiment 1.

Hereafter, embodiments of the present invention will be described with reference to drawings.

Supposing that a printing apparatus that can be controlled at precision of 600 DPI is used and a scanner is used as an image reading apparatus capable of clearly reading printed matter printed at the precision of 600 DPI, the present embodiment will be described. This resolution is an example of implementation, and implementation is possible with other resolutions as well. Furthermore, it is also possible to implement the image reading apparatus by using a digital camera or the like. Details of the implementation in that case are apparent to those skilled in the art.

The printing apparatus that is connected to a computer and that conducts printing on paper determines information to be printed on the paper surface by determining whether to conduct coloring every small point serving as the unit of control. In the ensuing description, a printing apparatus that conducts black and white printing on a region of 1/600 inch square according to whether to conduct coloring by using black ink is taken as an example. However, the present method is not restricted to such a printing apparatus. There are a printing apparatus that conducts a binary printing other than black and white, a printing apparatus capable of controlling coloring density in a plurality of steps every region, and a printing apparatus capable of controlling coloring using a plurality of colors. The present method can be implemented for those printing apparatus as well.

On the other hand, in a scanner for reading a printed paper surface, typical reading is conducted by regarding the paper surface as image data formed of pixels included in the region. Here, it cannot be anticipated for several reasons that reading is conducted so as to make all pixels at the time of printing coincide with pixels at the time of reading. As its causes, a difference in size between a unit pixel at the time of printing and that at the time of reading, movements in mechanical operations of the printing apparatus and the reading apparatus, spread or deviation of coloring at the time of printing, optical movement and blurring at the time of reading, and distortion of the paper surface are conceivable.

For executing a printed matter reliability decision stably especially in the viewpoint of falsification detection of printed information, it is demanded to stably print information to be printed and read the printed information with sufficient reproducibility. Especially when determining whether there is falsification on the basis of whether there is an image change on printed matter, it becomes necessary to avoid the influence of the above-described changes caused at the time of printing and reading.

In a printing apparatus having the above-described area of the 1/600 inch square as a minute pixel, it is supposed that information to be printed visibly on the paper surface is formed of a combination of printing constituent pixels each having a plurality of pixels. Here, a region taking the shape of a square and having 10 minute pixels in each of its longitudinal direction and its lateral direction, i.e., having a total of 100 minute pixels is used as a printing constituent pixel. In other words, this corresponds to printing using pixels having an area of 1/60 inch square.

FIG. 1 is a diagram showing an example in which a character to be printed is formed by using printing constituent pixels. In the ensuing description, it is supposed that a region taking the shape of a square and having 10 minute pixels in each of its longitudinal direction and its lateral direction is used as a printing constituent pixel. However, another size may also be used, and the shape of the region is not restricted to a square. Herein, information printed by using the pixels of 1/60 square is referred to as first information.

A concrete method of conducting printing using the 1/60 pixels can be implemented by, for example, using a character font in which each character is formed of such pixels. Or it can also be implemented by conducting image conversion processing on the first information formed as a higher definition image. By the way, even if 1/60-inch pixels are used, it is possible to print characters that can be sufficiently discriminated by many users, with a practical character size.

By thus using pixels each having a margin for the printing precision of the printing apparatus, printing with the influence of supposed errors caused at the time of printing being relatively reduced becomes possible. Furthermore, by using pixels each having a margin for the reading precision of the scanner, and by conducting correction processing based on the assumption that printing is conducted by using 1/60-inch pixels, on the read pixels, reading with the influence of supposed errors caused at the time of reading being relatively reduced becomes possible.

Figure 2:
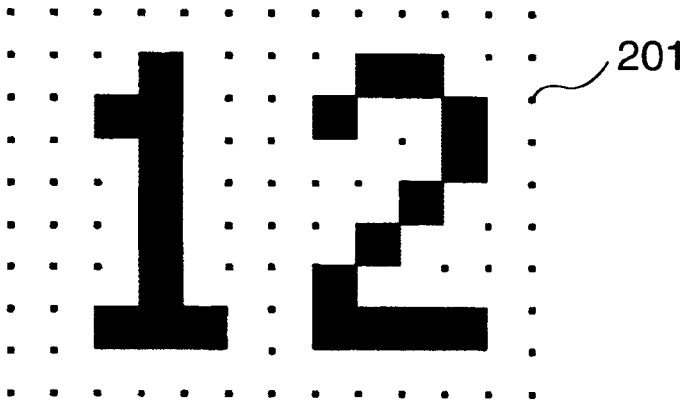
FIG. 2 is a diagram obtained by adding index points to the printing constituent pixels in the embodiment 1.

If there are indexes for discriminating boundaries between a printing constituent pixel and adjacent printing constituent pixels on the printing paper surface, then it becomes possible to conduct such correction processing at the time of reading more efficiently and at higher precision. To this end, index points should be arranged on the paper surface. As a concrete method, one minute pixel point can be disposed in a position of an upper left corner among pixels included in a printing constituent pixel. FIG. 2 is a diagram showing an example obtained by arranging minute pixels (201) serving as index points in FIG. 1. The index points constitute a background pattern for printing information on the paper surface.

With respect to the image read by the scanner, it becomes possible for a control apparatus to discriminate boundaries of a printing constituent image on the basis of the index points and conduct correction processing. As a result, the influence of local position deviations at the time of printing and at the time of reading, and expansion or contraction of the paper caused after printing can be reduced, and information recorded on the paper surface can be read stably.

Figure 3:
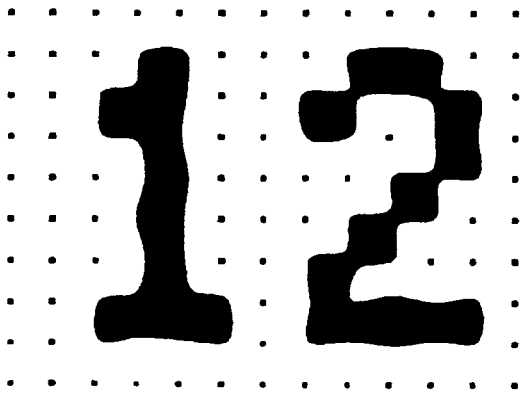
FIG. 3 is a diagram showing printed matter shown in FIG. 2 read by a scanner apparatus in the embodiment 1.

FIG. 3 is a diagram schematically showing an image read by the scanner. Although the image is shown exaggeratedly for description, boundaries of the printing constituent pixels become indistinct in FIG. 3. Furthermore, because of distortion of the paper surface and the reading errors, there are places read with partial expansion or contraction. By correcting the expansion or contraction on the basis of spaces between index points and correcting boundaries of the printing constituent pixels on the basis of positions of the index points, the state at the time of printing can be reproduced with high precision. By the way, the corrected printing constituent pixels correspond to those shown in FIG. 2. Thus, by conducting corrections based on the index points, boundaries and positions of the printing constituent pixels can be discriminated.

For detecting falsification of a printed document by thus conducting printing and reading, it becomes necessary to record at the time of printing how the first information has been printed and determine at the time of verification whether the actually printed information coincides with the recorded information. To this end, how the printing constituent pixels are arranged to represent the first information is recorded. In other words, spatial distribution of colored portions is regarded as a feature of the state of the printed matter, and a value representing the arrangement is recorded as a feature value.

As for a concrete method for recording a feature value, it is possible to conduct recording by using the index points. Information that represents the feature value to be recorded is treated as digital data having a combination of 0 and 1. Information to be recorded is assigned to index points in order beginning with the upper left index point.

Figure 4:
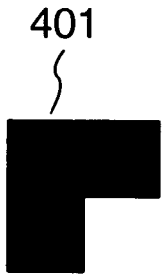
FIG. 4 is a diagram showing an index point corresponding to information 0 in each embodiment.
Figure 5:
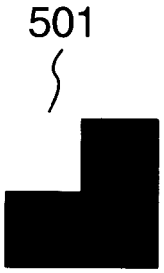
FIG. 5 is a diagram showing an index point corresponding to information 1 in each embodiment.

In order to represent 0 or 1, each index point is replaced by a shape formed by three pixels. As shown in FIG. 4, an index point corresponding to 0 is provided with a shape in which an upper left pixel 401 assumes the position of the original index point. On the other hand, as shown in FIG. 5, an index point corresponding to 1 is provided with a shape in which an upper left blank pixel 501 assumes the position of the original index point.

Even if such replacement is conducted, the position of the original index point can be discriminated on the basis of the shape. In addition, it is also possible to determine on the basis of the shape of each index point whether information recorded by the index point is 0 or 1.

However, the above-described shape and arrangement of the index point and information recording method using the index points have been described to show an example. Without being restricted to them, those skilled in the art can adopt a method suitable for this object.

Figure 13:
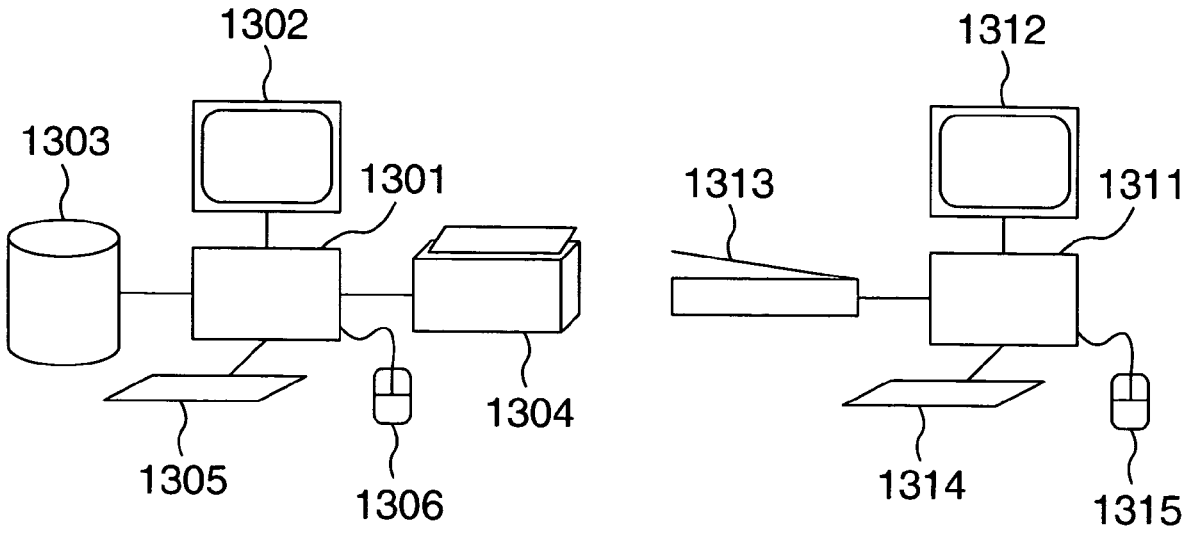
FIG. 13 is diagram showing a configuration example of a printing system and a verification system in each embodiment.

FIG. 13 is a diagram showing a configuration example of a printing system and a verification system that implement the present embodiment.

The printing system includes a computer (1301) serving as a control apparatus, a display apparatus (1302), an external storage (1303), a printing apparatus (1304), and input apparatuses (1305 and 1306).

The computer (1301) includes a CPU, a memory, and an interface for controlling the external storage (1303), the printing apparatus (1304), and the input apparatuses (1305 and 1306).

In the above-described configuration, the first information to be printed is stored in the external storage (1303). In response to an order from an operator given by using the input apparatuses (1305 and 1306), printing processing is conducted and the first information is printed as a paper document by the printing apparatus (1304).

The verification system includes a computer (1311) serving as a control apparatus, a display apparatus (1312), a scanner (1313), and input apparatuses (1314 and 1315).

The computer (1311) includes a CPU, a memory, and an interface for controlling the display apparatus (1312), the scanner (1313), and the input apparatuses (1314 and 1315).

In the above-described configuration, the paper document is read by using the scanner (1313), and a verification result is output to the display apparatus (1312).

Respective processing flows described hereafter are implemented by execution of a program stored in the external storage (1303) or the memory conducted by the CPU. The program may be previously stored in the external storage (1303) or the memory. Or the program may be introduced into the external storage (1303) or the memory via a storage medium or a transmission medium that can be used by the computer, as occasion demands. The storage medium is, for example, a CD-ROM or a DVD. The transmission medium is, for example, a communication line such as an optical cable or copper line, or an optical or electrical carrier or digital signal propagated on the communication line. The configuration of the system is not restricted to this, but the system can be implemented by using a suitable configuration.

Figure 9:
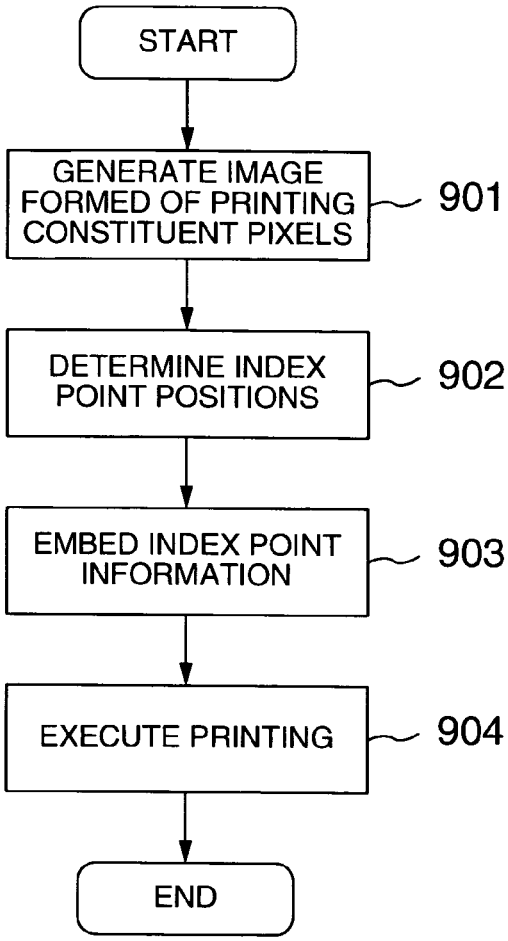
FIG. 9 is a diagram showing a processing procedure at the time of printing in the embodiment 1.
Figure 10:
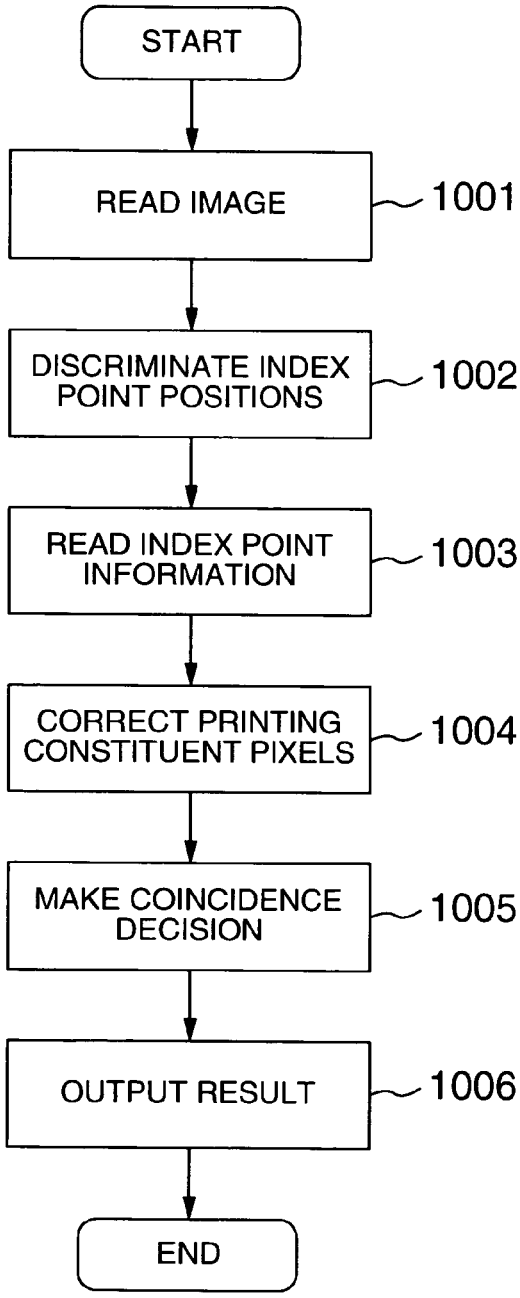
FIG. 10 is a diagram showing a processing procedure at the time of verification in the embodiment 1.

A processing procedure in the configuration heretofore described will now be described. Processing conducted at the time of printing is shown in FIG. 9, and processing conducted at the time of verification is shown in FIG. 10.

At the time of printing, an image obtained by forming the first information by means of printing constituent pixels is generated (step 901), and subsequently positions of index points are determined (step 902).

Subsequently, in order to represent information obtained by encoding the image generated at the step 901, each index point is replaced by the shape shown in FIG. 4 or 5 and thereby printing data with information embedded in index points is created (step 903). And printing is conducted (step 904).

Such an information recording method can be regarded as one method of what is called digital watermark technique. Instead of, or in addition to the above-described information recording method, another digital watermark technique may also be used in the present embodiment. In those digital watermark techniques, information recording can be conducted by changing an attribute such as the disposition, number, shape, color and density of minute pixels arranged on the printing surface, singly, or changing a combination of a plurality of attributes. Those skilled in the art can apply and execute a suitable digital watermark technique.

At the time of verification, printed matter is read by the scanner (1313) (step 1001). Positions of index points are discriminated with respect to the read image (step 1002). Subsequently, the feature value recorded at the time of printing is read on the basis of which of FIGS. 4 and 5 each index point represents (step 1003).

Subsequently, printing constituent pixel correction is conducted on the image read at the step 1001 on the basis of index point positions read at the step 1002 (step 1004). Subsequently, it is determined whether a feature value based on the image corrected at the step 1004 coincides with the information read at the step 1003 (step 1005), and its result is output (step 1006).

By the way, it is also possible to construct a printing system so as to display a warning at the time of printing if information for detecting falsification of the first information cannot be recorded sufficiently. Here, the expression "information cannot be recorded sufficiently" includes the case where the amount of information to be recorded is larger than the amount of information that can be recorded.

Or a portion that cannot be completely recorded may also be recorded by using another method. Specifically, the portion may be recorded, for example, on the paper surface by using a method such as a bar code. Or it is possible to record only an identifier determined by using a predetermined method on the paper surface, and record information for detecting falsification of the first information on a database apparatus in association with this identifier. In the case where such recording has been conducted, recorded information is obtained by using a method corresponding to the recording method at the time of verification and used for the verification processing.

Or it is possible to use an error correction code when recording information, and correct reading errors by using this error correction code when reading the recorded information. It is also conceivable that an index point cannot be read for the reason that the first information and the index point overlap in position. In some cases, it becomes possible to cope with such a situation by applying an error correction code.

Or when recording information, the index point for recording information may be selected and recorded in order to avoid becoming unable to read the information for the reason that the first information and the index point overlap in position.

Or information to be recorded may be encrypted and then recorded. Or an electronic signature may be added to information to be recorded, and recorded. For the encryption and electronic signature, a public key encryption may also be used. Furthermore, in that case, a public key used for decryption of cryptograph and signature verification may also be recorded together. Furthermore, in that case, a public key certificate for the public key may also be recorded.

It is also possible to make the background pattern include pixels other than index points. Furthermore information may be recorded by using pixels other than these index points.

As for more concrete implementation methods for them, those skilled in the art can implement the methods by using suitable methods.

Although the present embodiment has been described as a processing procedure on the computer, the present embodiment can also be implemented as an apparatus implementing the present processing.

Furthermore, it is also possible to construct the computer (1301) and the printing apparatus (1304), and the computer (1311) and the scanner (1313) respectively as apparatuses each united into one body.

In the present embodiment, information for prescribing a region of a printing surface in which a sampling region is disposed on the paper surface, information for determining the sampling region, and a value representing whether there is coloring for the sampling region are used as a feature value of printed matter. It is now supposed that the sampling region is a square-shaped region having two pixels in each side. A region of the paper surface in which information especially demanded to have reliability is to be printed is selected as the sampling region and disposed. It is supposed that the information especially demanded to have reliability is, for example, information such as the amount of received money in a receipt. Here, this region is selected as a rectangular region that can be determined by coordinate values on the paper surface. Specification of this region can be executed by predetermining the region every document kind to be printed. Or specification of this region can also be executed by previously displaying a printing image of a document to an operator of a printing system every document to be printed and making the operator select a subject region.

Furthermore, it is supposed that the position in which the sampling region is disposed can be represented by coordinate values for the sampling region, and the coordinates are determined by determining a parameter for a predetermined method. Here, as for the predetermined method, for example, a method of determining coordinates on the basis of a random number sequence determined by a parameter is conceivable.

If a certain parameter is given, then a plurality of sampling regions dispersed at random can be determined, in this method. If given parameters are the same, in this method a constant position of the sampling region can be obtained. On the contrary, for different parameters, sampling regions having different dispersions can be obtained in this method. As for a more concrete implementation method for such a position determining method, those skilled in the art can select and apply a suitable method.

If positions of the sampling regions are thus determined, then it can be determined whether to conduct coloring based on information to be printed on the paper surface in those sampling regions. Herein, information to be printed on the paper surface and to be determined whether to conduct coloring is referred to as first information. If a coloring portion based on printing of the first information is included in each sampling region, then the first information is judged to be present in the sampling region.

If a coloring portion based on printing of the first information is not included in each sampling region, then a coloring portion based on the first information is judged not to be present in the sampling region. By conducting such a decision for each sampling region, the state of the paper surface of printed matter can be grasped as presence or absence of coloring on sampling regions.

Figure 6:
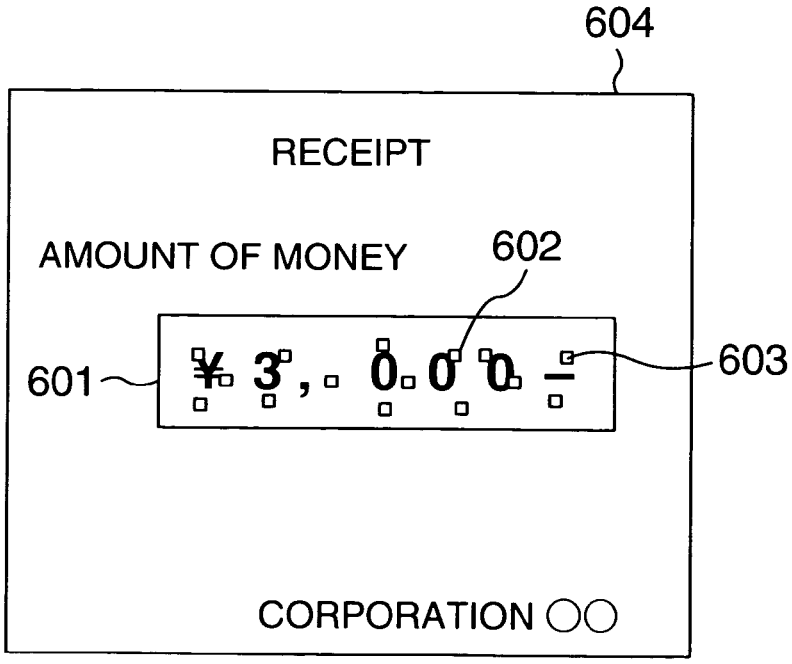
FIG. 6 is a diagram showing sampling conducted on printed matter in an embodiment 2.

FIG. 6 is a schematic diagram showing this sampling method. Printed matter (receipt) 604 with the sampling method applied thereto is exemplified. In FIG. 6, a subject region to be subjected to sampling is denoted by 601. An amount of money drawn in the region 601 is the first information to be printed. Furthermore, points 602, 603 and so on are sampling regions. However, this sampling region is not actually printed on the paper surface. In FIG. 6, the point 602 indicates an example of a sampling region including a coloring portion of the first information, and the point 603 indicates an example of a sampling region that does not include a coloring portion of the first information.

If sampling is conducted in this way, then it becomes possible to record the state of the paper surface of the printed matter by using values of three kinds, i.e., a value for determining a rectangular region to be sampled, a parameter for determining a sampling region, and a sampling value for representing the presence or absence of coloring on each sampling region.

Here, information is recorded by drawing minute pixels at intervals of 10 pixels in the longitudinal and lateral directions on the paper surface, and using the shape representing 0 shown in FIG. 4 and the shape representing 1 shown in FIG. 5 properly for each point. Furthermore, here, minute pixels are not drawn in the rectangular region to be subjected to sampling in order to prevent the minute pixels from being regarded as a change in the paper surface state on the printed matter. In other words, recording is conducted by drawing minute pixels taking the shape shown in FIG. 4 or 5 in a place on the printed matter 604 other than the sampling subject region 601. The minute pixels become a background pattern for the paper surface. The minute pixels and the sampling regions are arranged so that their relative positions may be determined in predetermined rules.

Recording of the result of the presence or absence of coloring in the sampling region and the state of the paper surface using minute pixels is executed by forming the state of the printed paper surface on the storage region of the printing system, making a decision whether coloring is present for the sampling region and arranging the minute pixels, on the storage region, and then actually conducting printing on the paper surface together with the first information by using the printing apparatus (1304).

FIG. 13 is a diagram showing a configuration example of a printing system and a verification system for implementing the present embodiment. Components shown in FIG. 13 are the same as those described with reference to the embodiment 1.

Figure 11:
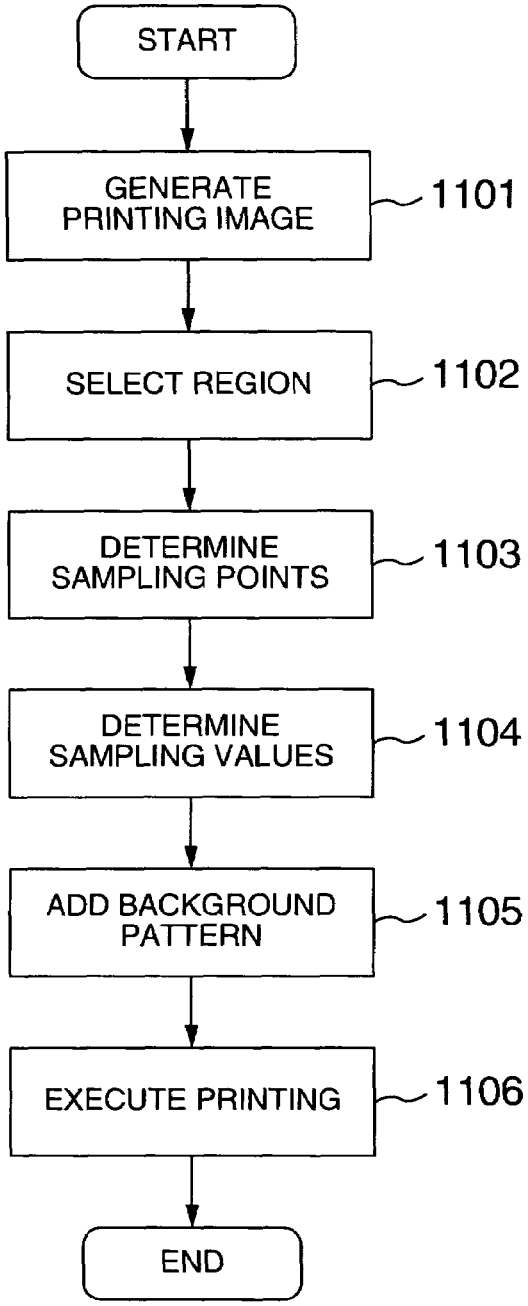
FIG. 11 is a diagram showing a processing procedure at the time of printing in the embodiment 2.
Figure 12:
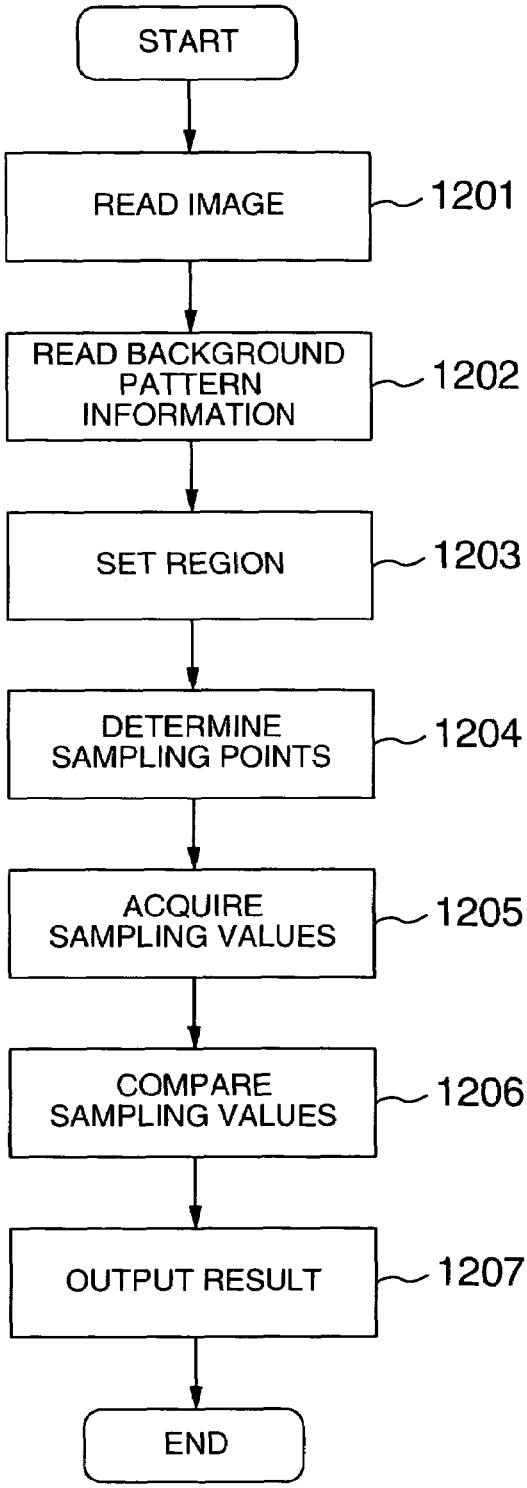
FIG. 12 is a diagram showing a processing procedure at the time of verification in the embodiment 2.

A procedure of printing processing in the configuration heretofore described is shown in the lump in FIG. 11. First, a printing image corresponding to the first information is generated on the storage region (step 1101). Subsequently, a rectangular region that becomes a subject of sampling is selected (step 1102). Positions of sampling regions in the subject region are determined (step 1103), and sampling values are acquired (step 1104). The background pattern that represents the values of the above-described three kinds is added to the printing image generated at the step 1101 (step 1105), and printing is executed (step 1106).

Processing conducted when making a decision on reliability for the printed matter thus created will be described hereafter.

First, the paper surface is read by the scanner apparatus (1313), and image data corresponding to the paper surface is acquired (step 1201). Subsequently, values of three kinds, i.e., values that determine the rectangular region of the sampling subject recorded by using minute pixels from image data, parameters that determine the sampling regions, and sampling values representing the presence or absence of coloring for respective sampling regions, are read (step 1202).

Subsequently, the rectangular region (601) that becomes the subject of sampling for the image data on the paper surface is judged on the basis of the read values that determine the rectangular region of the sampling subject (step 1203).

Subsequently, points to be sampled in the above-described rectangular region (601) are determined on the basis of the read parameters for determining the sampling regions (step 1204). Presence or absence of coloring for each point of sampling region is acquired (step 1205). Sampling values thus obtained are compared with the sampling values representing whether coloring is present for respective sampling regions read from minute pixels at the step 1202 (step 1206), and a result is output (step 1207).

It is determined whether presence or absence of coloring for each sampling region coincides with other as a result of comparison. Verification may be judged to be successful only when coincidence is found for all sampling regions. Or verification may be judged to be successful when coincidence is found for points assuming at least a predetermined ratio. Or coincident points and noncoincident points may be displayed without conducting processing of making a decision whether verification is successful, and the operator of the verification apparatus may form a decision on the basis of the display.

By the way, when discriminating a subject region of sampling and sampling regions from the image data on the paper surface, it is also possible to use minute pixels added to record information as indexes for position discrimination. Because of a movement at the time of printing, expansion and contraction of paper itself, and a movement at the time of reading, there is a possibility that read image data might include spatial errors. On the other hand, the minute pixels are drawn at constant intervals on the paper surface. By using the minute pixels as indexes, it becomes possible to correct read image data and make a decision every place on the paper surface. By conducting correction every place, it also becomes possible to cope with errors caused by partial expansion and contraction of paper.

The method of conducting recording on the paper surface by using minute pixels has been described. However, this method is not restrictive. For example, a method of expressing and recording information on the paper surface by using characters, or a method of recording information by using a bar code may also be used. Or a method of electromagnetically recording information in a database in association with an identifier of printed matter may also be used. Details of execution of these methods are apparent to those skilled in the art.

Or it is also possible to make the background pattern include pixels other than index points. In addition, information may be recorded by using pixels other than the index points as well.

It has been supposed in the foregoing description that there is one rectangular region that becomes the subject of sampling conducted on the printed matter. However, a plurality of regions may also be set. Furthermore, the subject region of sampling may take a shape other than rectangles.

Although the present embodiment has been described as a processing procedure on the computer (1301), the present embodiment can also be implemented as an apparatus implementing the present processing.

Furthermore, it is also possible to construct the computer (1301) and the printing apparatus (1304), and the computer (1311) and the scanner (1313) respectively as apparatuses each united into one body.

In the present embodiment, a result obtained by observing coloring conducted on the paper surface, with a high magnifying power is used as a feature value of printed matter. This observation is conducted in a series of printing processes of a sheet of printed matter. A result of the observation is reflected in the remaining printing process, and the observation result is recorded on the printed matter. Details will be described hereafter.

Figure 7:
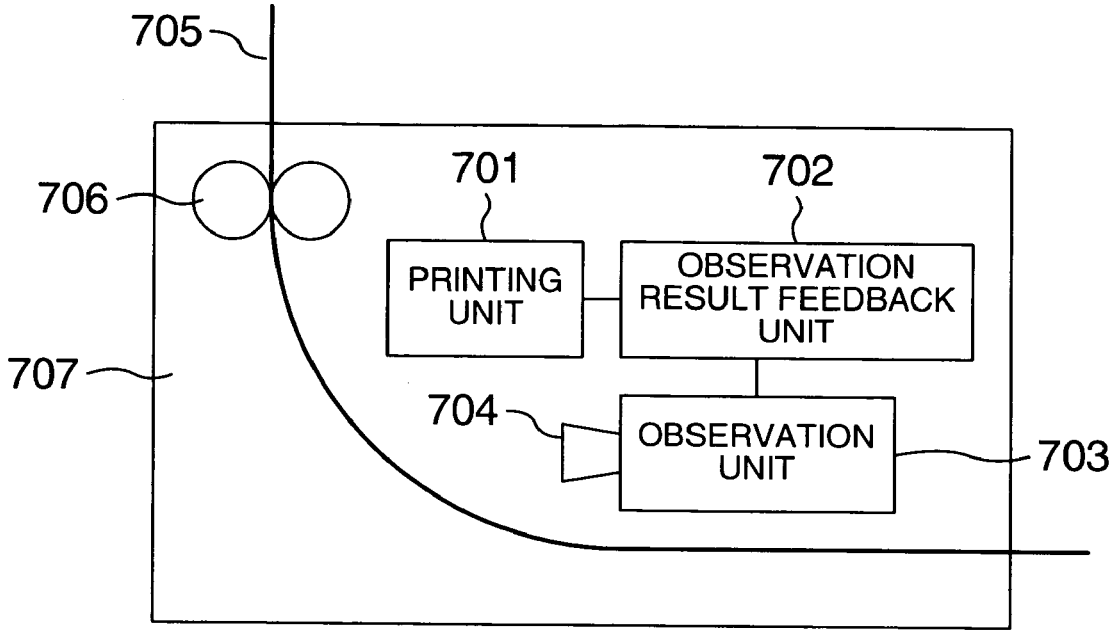
FIG. 7 is a diagram showing a printing apparatus including an observation unit and an observation result feedback unit in an embodiment 3.

FIG. 13 is a diagram showing a configuration example of a printing system and a verification system according to the present embodiment. Components shown in FIG. 13 are the same as those described with reference to the first embodiment. FIG. 7 is a configuration image diagram of a printing apparatus (707) to which the present method has been applied.

The printing apparatus includes at least a printing unit (701), an observation unit (703) and an observation result feedback unit (702). The observation unit (703) is disposed so as to be able to observe coloring conducted by the printing unit (701). In addition, the observation unit (703) has a mechanism capable of observing the paper surface with a high magnifying power. This can be implemented by, for example, providing an optical magnifying lens having a high magnifying power.

The observation unit (703) observes coloring conducted on a predetermined place by the printing unit (701), and delivers a result of the observation to the observation result feedback unit (702).

The place to be observed may be located on predetermined coordinates on the paper surface. Or the place to be observed may be a place on the paper surface where a predetermined shape has been formed. For example, a period "." first printed on the paper surface may be observed.

Figure 8:
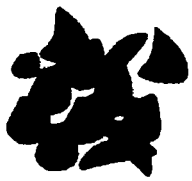
FIG. 8 is a diagram showing a printing result of one pixel in printing using toner in the embodiment 3.

Coloring conducted by the printing unit (701) indicates physical dispersion (fluctuation) that is impossible or very difficult to control. For example, when conducting coloring using toner, it is difficult to make the shape of toner powder and scattering of toner powder at the time of application homogeneous. For example, when a point of only one pixel has been printed, the state of application of toner powder on that point is enlarged and observed. As schematically shown in FIG. 8, printing is conducted by sticking several particles of inhomogeneous toner powder to the paper. Or when conducting coloring using ink, the amount of emission and position of ink include errors. Furthermore, the result of coloring is also affected by fiber of paper, which becomes the subject of coloring, resulting in spread. When the result of coloring is thus observed with a high magnifying power, dispersion that is difficult to control artificially is included. By observing and recording such dispersion (fluctuation), therefore, it becomes possible to record feature values that are difficult to duplicate, every individual printed matter.

The observation result feedback unit (702) encodes the observation result of the observation unit (703) to reflect the encoded observation result into a printing process of the printed matter and conduct recording. The encoding may be implemented by representing the observation result as image data. That recording may be conducted by arranging minute pixels as shown in FIGS. 4 and 5 on the printed matter. Or that recording may be conducted by adding a bar code to the printed matter. As for the concrete feedback method of the printing result, a suitable method can be used from among a series of printing processes capable of being conducted on that printed matter.

At the time of verification, it becomes possible to ensure that the printed matter is not a duplicated one, by observing observation places on the printed matter again and comparing a result of the observation with the result of the observation conducted at the time of printing recorded on the printed matter.

Furthermore, in recording on the paper surface, it is also possible to conduct encryption processing and electronic signature processing.

For example, it is possible to conduct observation on an arbitrary position of the paper surface, encrypt parameters that determine the observation position and an observation result, and record the encrypted parameters and observation result on the paper surface. In this case, it becomes possible for only a person who can decrypt the encrypted and recorded information to conduct verification. In this embodiment, the observation place is kept secret by the encryption. Therefore, it becomes necessary for a person who attempts to duplicate the paper document to duplicate all places having a possibility to become the observation subject, with high precision. As a result, it becomes possible to make duplication more difficult.

Furthermore, in the present embodiment, an example in which the printing apparatus (1304) includes the feedback unit (702) has been shown. Implementation is not restricted to this. For example, it is also possible to deliver the observation result to the computer (1301) serving as a control apparatus, which is connected to the printing apparatus (1304) and which issues an order of printing, conduct feedback processing in the computer (1301), and conduct recording in printing conducted in the printing unit (701).

Furthermore, it is also possible to construct the computer (1301) and the printing apparatus (1304), and the computer (1311) and the scanner (1313) respectively as apparatuses each united into one body.

The specification and drawings are, accordingly, to be regarded in an illustrative rather than a restrictive sense. It will, however, be evident that various modifications and changes may be made thereto without departing from the spirit and scope of the invention as set forth in the claims.

The invention claimed is:

1. A recording method of reliability decision information on printed matter using a printing system, the printing system including a printing apparatus and a control apparatus for the printing apparatus, characterized in that the printing apparatus provides a printing surface partially with a color and thereby records first information on the printing surface under control of the control apparatus;

the control apparatus determines a feature value of the printed matter on the basis of spatial distribution of the coloring portions on the printing surface at time when the first information is printed on the printing surface; and the printing apparatus records the feature value on the printing surface together with the first information.

2. A reliability decision method of printed matter using the recording method of reliability decision information on printed matter according to claim 1, the reliability decision method being used by a verification apparatus including an image reading apparatus and a control apparatus for the image reading apparatus, characterized in that the image reading apparatus reads the feature value and the first information printed on the printing surface, under control of the control apparatus for the image reading apparatus; and the control apparatus for the image reading apparatus conducts comparison on the feature value and the first information printed on the printed matter, and makes a decision on reliability of the printed matter.

3. The reliability decision method of printed matter according to claim 2, characterized in that the control apparatus for the image reading apparatus makes a decision on at least one of boundaries and a position of the printing constituent pixel included in the first information by using the background pattern as reference, as regards the first information read from the printing surface by the image reading apparatus.

4. The recording method of reliability decision information on printed matter according to claim 1, characterized in that the control apparatus determines spatial distribution of the coloring portions on the printing surface, at time when the printing apparatus prints the first information by taking a printing constituent pixel as unit, the printing constituent pixel being constituted by a predetermined number of minute pixels each taken as unit when conducting coloring on the printing surface, takes a value prescribing disposition of the printing constituent pixel concerning the first information as the feature value included on the printed matter, takes a plurality of index points constituted by using a smaller number of minute pixels than the predetermined number constituting the printing constituent pixel, as a background pattern having a predetermined relative arrangement relative to the printing constituent pixel, and conducts printing.

5. The recording method of reliability decision information on printed matter according to claim 4, characterized in that the control apparatus constitutes the background pattern by arranging a plurality of the index points, provides each of the index points with a shape formed by a predetermined arrangement of the minute pixels, determines disposition of the index points according to a predetermined rule, and disposes the printing constituent pixels concerning the first information in a region including an occupying region on the printing surface.

6. The recording method of reliability decision information on printed matter according to claim 1, characterized in that the feature value is recorded by changing any of disposition, number, shape, color and density of minute pixels arranged on the printing surface.

7. The recording method of reliability decision information on printed matter according to claim 1, characterized in that the control apparatus determines at least one sampling region taking a predetermined shape on the printing surface, and takes information representing presence or absence of the coloring portion concerning the first information in the sampling region as the feature value.

8. The recording method of reliability decision information on printed matter according to claim 7, characterized in that the control apparatus determines a position of the sampling region on the basis of a relative position with respect to the minute pixels constituting the background pattern.

9. The recording method of reliability decision information on printed matter according to claim 1, characterized in that the control apparatus disposes the sampling region in a specific region on the printing surface.

10. The recording method of reliability decision information on printed matter according to claim 8, characterized in that the control apparatus records at least one of:

information for prescribing a region on the printing surface in which the sampling region is disposed;

a parameter for determining disposition of the sampling region in the region on the printing surface; and a feature value acquired as presence or absence of coloring for the sampling region on the paper surface.

11. The recording method of reliability decision information on printed matter according to claim 1, characterized in that the printing apparatus comprises an observation unit which observes fluctuation in coloring shape or coloring position of a minute pixel taken as unit when conducting coloring on the printing surface, and the control apparatus determines the feature value on the basis of the fluctuation.

12. The recording method of reliability decision information on printed matter according to claim 11, characterized in that the control apparatus encrypts information of position on the printing surface in which the fluctuation is to be observed to determine the feature value of the printed matter, or the position information and the feature value of the printed matter, and causes the position information, or the position information and the feature value of the printed matter thus encrypted, to be recorded on the printing surface.

* * * * *